United States Patent [19]

Sugiyama

[11] Patent Number: 5,073,802

[45] Date of Patent: Dec. 17, 1991

[54] IMAGE FORMING APPARATUS CAPABLE OF CHANGING IMAGE FORMING MODES DURING CONTINUOUS IMAGE FORMING OPERATION

[75] Inventor: Tsukasa Sugiyama, Moriguchi, Japan

[73] Assignee: Mita Industrial Co., Ltd., Osaka, Japan

[21] Appl. No.: 525,669

[22] Filed: May 21, 1990

[30] Foreign Application Priority Data

May 29, 1989 [JP] Japan ..... 1-137168

[51] Int. Cl.[5] ..... G03G 21/00

[52] U.S. Cl. ..... 355/313; 271/270; 355/218; 355/243; 355/309

[58] Field of Search ..... 355/243, 308, 309, 311, 355/313, 316, 317, 314, 218; 271/3, 161, 270

[56] References Cited

U.S. PATENT DOCUMENTS

| | | | |
|---|---|---|---|
| 4,129,377 | 12/1978 | Miyamoto et al. | 355/317 |
| 4,461,564 | 7/1984 | Ikenoue | 355/243 |
| 4,497,569 | 2/1985 | Booth, Sr. | 355/206 |
| 4,595,275 | 6/1986 | Sinobe | 355/243 |
| 4,714,941 | 12/1987 | Yamagishi et al. | 355/243 |
| 4,739,376 | 4/1988 | Kanekol | 355/309 X |
| 4,745,441 | 5/1988 | Maruta et al. | 355/218 |
| 4,819,029 | 4/1989 | Ito | 355/218 |
| 4,941,017 | 7/1990 | Mishima et al. | 355/218 |

FOREIGN PATENT DOCUMENTS

| | | |
|---|---|---|
| 59-223636 | 12/1984 | Japan . |
| 60-48834 | 3/1985 | Japan . |
| 60-48835 | 3/1985 | Japan . |
| 63-180634 | 7/1988 | Japan . |

*Primary Examiner*—Arthur T. Grimley
*Assistant Examiner*—J. E. Barlow, Jr.
*Attorney, Agent, or Firm*—Antonelli, Terry, Stout & Kraus

[57] ABSTRACT

The present invention relates to an image forming apparatus for carrying out image forming in any of a plurality of image forming modes by changing the relationship between the drive starting time of the document scanner and the time at which registration rollers feed paper to the image forming unit. The paper feeding unit is adapted to feed paper from a paper housing unit at predetermined time intervals, determined according to the sizes of paper. The time intervals at which the registration rollers feed paper to the image forming unit are equal to these predetermined time intervals. Such predetermined time intervals remain unchanged for all image forming modes. Further, the period of time during which paper is once stopped by the registration rollers remains unchanged even though the image forming mode is changed. Accordingly, in a series of image forming operations, the time at which the registration roller feed paper to the image forming unit remains unchanged in any image forming mode or even though the image forming mode is changed. When the image forming mode is changed, it is required to change accordingly the relationship between the time at which the registration roller feed paper and the drive starting time of the document scanner. Such a change is made solely by changing the drive starting time of the document scanning means.

8 Claims, 5 Drawing Sheets

IMAGE FORMING APPARATUS CAPABLE OF CHANGING IMAGE FORMING MODES DURING CONTINUOUS IMAGE FORMING OPERATION

BACKGROUND OF THE INVENTION

The present invention relates to an image forming apparatus, such as a copying apparatus or the like, and more particularly to an image forming apparatus having a plurality of image forming modes such as, in the copying apparatus, a normal copying mode, a margin shift copying mode, a variable magnification copying mode and the like.

There have been conventionally used a variety of image forming apparatus for recording an image on paper. In an electrophotographic copying apparatus for example, copy paper is successively fed from a copy paper housing unit at predetermined time intervals, and delivered to registration rollers disposed in the vicinity of a transfer unit for transferring a toner image formed on the surface of a photoreceptor to the copy paper. The registration rollers cause the paper to be stopped. Thereafter, the paper is fed to the transfer unit with predetermined timing in synchronism with the rotation of the toner image on the photoreceptor.

Recently, copying apparatus is apt to be made in a larger scale and to be operated at a higher speed, thereby to lengthen the paper delivery passage from the paper housing unit to the registration rollers. Accordingly, when continuously carrying out a copying operation on a plurality of paper sheets, there are instances where a plurality of paper sheets are present in the delivery passage. Therefore, if the period of time during which each copy paper is stopped by the registration rollers, is changed, this may cause paper sheets to come into collision with each other or to be jammed in the delivery passage. Thus, the period of time that the paper is stopped cannot be changed while copy paper sheets are present in the delivery passage.

However, when the copying mode is changed, it becomes necessary to change the relationship between the exposure starting time of the photoreceptor and the drive starting time of the registration rollers. For example, in a margin shift copying mode for providing a margin at the left or right end of copy paper, it is required to advance or delay the drive starting time of the registration rollers according to the required margin width. On the other hand, in the enlargement copying mode or the like where it is required to operate the optical system at a lower speed with respect to the paper delivery speed, the time required for the optical system to reach the document read starting position after the optical system has started operating is lengthened. This causes the document read starting time, to be delayed. It is therefore required that the drive starting time of the registration rollers be delayed according to such a delay. However, the paper stop time cannot be changed while paper sheets are present in the paper delivery passage. This presents the problem that the copying mode cannot be changed.

An example of prior art for overcoming the problem above-mentioned is disclosed in, for example, JP-A-111651/1984. The paper feed control technique proposed in the document above-mentioned is so arranged as to change the time at which copy paper is taken out from the paper housing unit, based on the change in drive starting time of the registration rollers.

In the prior art proposed in the document above-mentioned, even though the time at which copy paper is taken out from the paper housing unit can be changed based on the change in drive starting time of the registration rollers, it is not possible to change the time at which the already taken copy paper, present in the paper delivery passage between the paper housing unit and the registration rollers, is delivered to the registration rollers. Accordingly, even in the prior art above-mentioned, the period of time during which copy paper is stopped by the registration rollers is temporarily changed when the copying mode is changed. This results in the likelihood that paper sheets come into collision with each other or are jammed in the paper delivery passage.

SUMMARY OF THE INVENTION

It is an object of the present invention to provide an image forming apparatus in which no paper jam occurs even though the image forming mode is changed, thereby to assure smooth change to an image forming mode to be selected from a plurality of image forming modes.

It is another object of the present invention to provide an image forming apparatus particularly advantageous in image forming at a high speed.

According to the image forming apparatus of the present invention, paper feed means takes out paper from a paper housing unit at predetermined time intervals determined according to the size of the paper. Registration means feeds the paper to image forming means after the paper has been stopped for a predetermined period of time. In such paper feeding, the paper feed time intervals are equal to the predetermined time intervals above-mentioned. The registration means maintains the predetermined paper stop time constant in any image forming mode, or even though the image forming mode is changed. Accordingly, in a series of image forming operations, the time at which paper is fed to the image forming means remains unchanged. Change in the relationship between the time at which paper is fed to the image forming means and the drive starting time of the document scanning means, is solely made by changing the drive starting time of the document scanning means.

For example, an electrophotographic copying apparatus is adapted to carry out a copying operation in a copying mode selected from a plurality of copying modes including a margin shift copying mode for providing a margin at a paper end, a normal copying mode for copying a document without such a margin provided, and the like. In the margin shift copying mode, it is required that the positional relationship between the image on a photoreceptor, functioning as the image forming means, and paper fed to this photoreceptor, be different from that in the normal copying mode In this connection, the present invention is so arranged as to advance or delay the drive starting time of the document scanning means as compared with that in the normal copying mode. This produces a change in the time at which the image is formed on the surface of the photoreceptor. Accordingly, the time at which the image formed on the surface of the photoreceptor reaches the transfer position, where the image is transferred to the paper, is shifted with respect to that in the normal copying mode. This causes the positional relationship between the paper and the image on the photoreceptor surface to be changed with respect to that in the normal copying mode. This assures reproduction with a margin provided.

According to the present invention, in such a margin shift copying mode, the time at which the registration means feeds paper to the photoreceptor, is the same as in the normal copying mode, as mentioned earlier. That is, only the drive starting time of the document scanning means undergoes a change. As above-mentioned, the stop time, during which paper is being stopped by the registration means, remains unchanged in any copying mode or even though the copying mode is changed. Accordingly, even though the copying mode is changed with paper being present in the paper delivery passage between the paper feed means and the registration means, there is no likelihood of paper collision and paper jam in the paper delivery passage. Thus, smooth change in, image forming mode may be assured. This is particularly advantageous in image forming on a plurality of paper sheets at a high speed where a plurality of paper sheets are present in close vicinity to one another in the paper delivery passage.

According to the present invention, the copying operations in other modes than the margin shift copying mode, conventionally made by changing the time at which paper is fed to the photoreceptor, may be made by changing the drive starting time of the document scanning means, as done in the margin shift copying mode above-mentioned.

These features of the present invention will be apparent from the following description with reference to the attached drawings.

DESCRIPTION OF THE PREFERRED EMBODIMENTS

Figure 2:
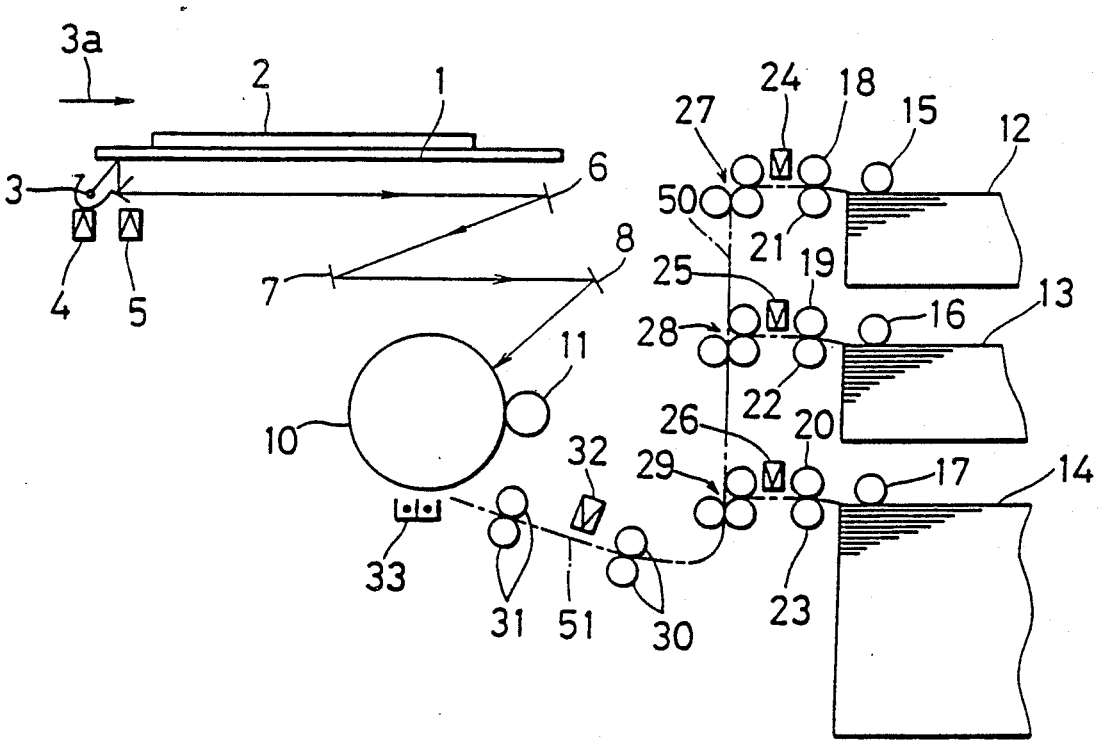
FIG. 2 is schematic view illustrating the arrangement of portions of an electrophotographic copying apparatus relating to the image forming apparatus embodying the present invention.

FIG. 2 is a schematic view illustrating the arrangement of portions of an electrophotographic copying apparatus relating to an image forming apparatus embodying the present invention.

In FIG. 2, a document 2 is set on a transparent plate 1. Disposed under, the transparent plate 1 is a light source 3 for illuminating and scanning the document 2. The light source 3 is movable transversely in FIG. 2. When the light source 3 is located in a predetermined stop position, i.e., a home position, a home switch 4 is turned ON. When the light source 3 starts moving from the home position in 25 the direction shown by an arrow 3*a* and reaches a scan starting position where the light source 3 starts substantially illumining the document 2, a timing switch 5 is turned ON. By monitoring the output from the home switch 4, it is determined whether the light source 3 is located in the home position or not. By monitoring the output from the timing switch 5, there may be detected the time at which the light source 3 passes through the scan starting position.

When the document 2 is illuminated by the light source 3, the light reflected from the surface of the document 2 is guided to a photoreceptor drum 10 by reflecting mirrors 6, 7, 8. The photoreceptor drum 10 is exposed to the reflected light from the document 2 thus guided to the photoreceptor drum 10, so that an electrostatic latent image is formed on the surface of the photoreceptor drum 10. The electrostatic latent image thus formed is developed into a toner image by a developing device 11.

The copying apparatus further includes three paper housing units 12, 13, 14. Disposed correspondingly to the respective paper housing units 12, 13, 14 are forward feeding rollers 15, 16, 17, paper feeding rollers 18, 19, 20, retard rollers 21, 22, 23 and paper detector switches 24, 25, 26. Each of the forward feeding rollers 15, 16, 17 takes out paper housed in the corresponding paper housing units 12, 13, 14 successively from the top paper. Each of the paper feeding rollers 18, 19, 20 delivers the paper taken out from the corresponding paper housing units 12, 13, 14 to a paper delivery passage 50. The retard rollers 21, 22, 23 respectively disposed correspondingly to the paper feeding rollers 18, 19, 20 are rotated in the direction of rotation identical with that of the corresponding paper feeding rollers 18, 19, 20 (i.e., a direction of rotation for delivering paper in the direction opposite to the direction in which the paper is delivered by the paper feeding rollers 18, 19, 20), thereby to prevent a plurality of paper sheets from being simultaneously fed. The retard rollers 21, 22, 23 are rotated with less torque than that with which the paper feeding rollers 18, 19, 20 are rotated. Each set of a forward feeding roller, a paper feeding roller and a retard roller is simultaneously started or stopped by a paper feeding clutch (not shown), and is adapted to feed paper to the paper delivery passage 50 at predetermined time intervals determined according to the size of paper.

Paper taken out from each of the paper housing units 12, 13, 14 is detected by the paper feeding switches 24, 25, 26. Further, the paper is delivered to the paper delivery passage 50 by each set of field rollers 27, 28, 29, and then guided to registration rollers 31 through loop rollers 30. A registration switch 32 is disposed in paper delivery passage 51 between the loop rollers 30 and the registration rollers 31. This registration switch 32 is adapted to detect paper delivered toward the registration rollers 31. The registration rollers 31 are adapted to feed paper to the photoreceptor drum 10 with a predetermined timing. The loop rollers 30 advance paper even after the paper tip comes in contact with the registration rollers 31, thus causing the paper to be bent by a predetermined amount immediately before the registration rollers 31. When the paper is bent in this way, the paper tip may sufficiently come in contact with the registration rollers 31 to prevent the paper from being obliquely fed to the photoreceptor drum 10.

Figure 3:
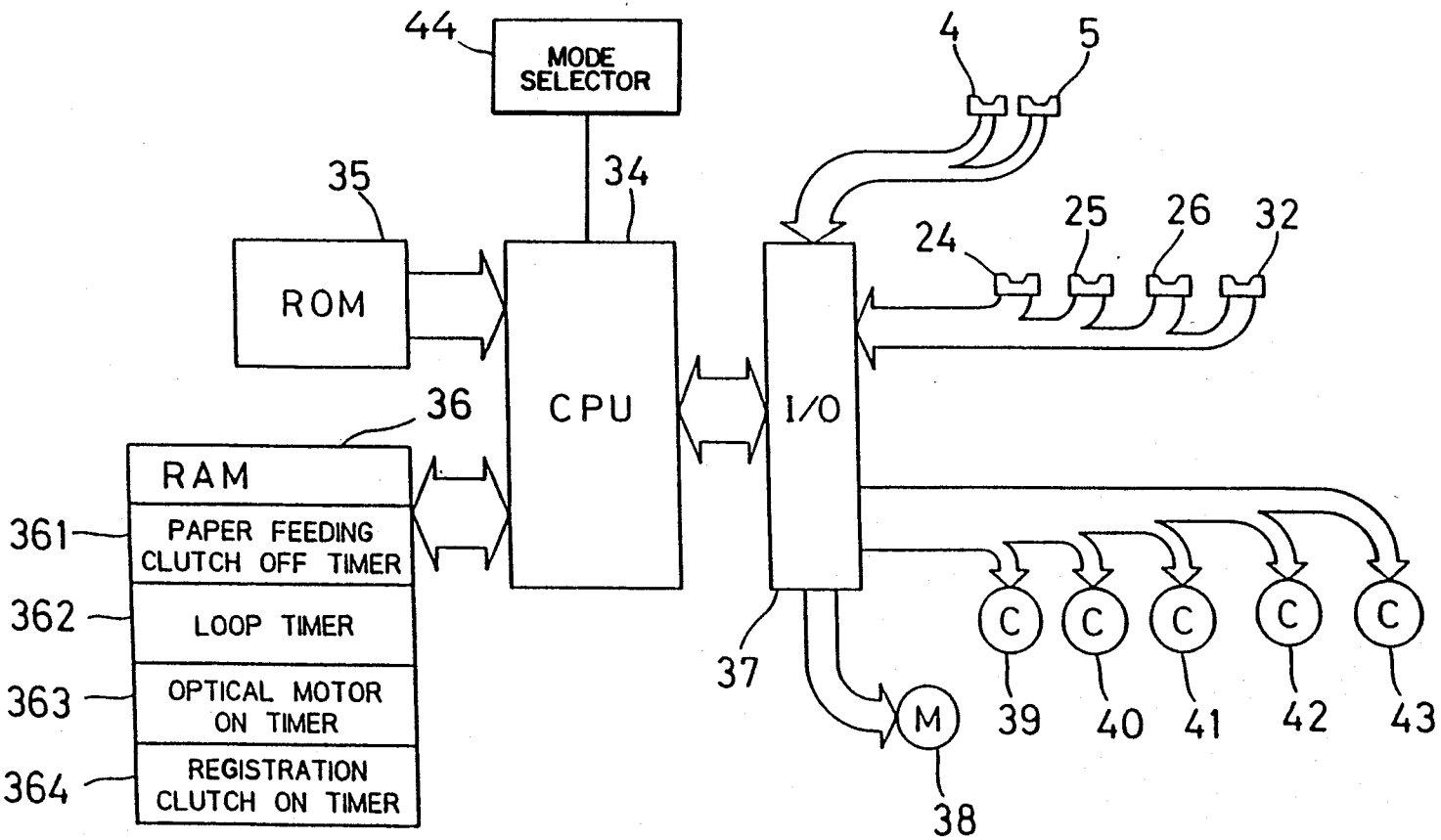
FIG. 3 is a block diagram illustrating the arrangement of an electric circuit used in the image forming apparatus embodying the present invention.

The paper fed to the photoreceptor drum 10 by the registration rollers 31 sticks to the surface of the photoreceptor drum 10, so that the toner image on the surface of the photoreceptor drum 10 is transferred to the paper surface by a transferring corona discharger 33. The subsequent processing, such as a fixing processing and the like, do not relate directly to the present invention and are well known. Accordingly, a further description of these subsequent processings will be here omitted, FIG. 3 is a block diagram of the arrangement of an electric circuit for operating the mechanism in FIG. 2. As shown in FIG. 3, the electric circuit comprises a CPU 34 serving as a control center, a ROM 35 containing the operation program for the CPU 34, a RAM 36 for storing data and the like, and an I/O interface 37. The RAM 36 has a paper feeding clutch OFF timer area 361, a loop timer area 362, an optical motor ON timer area 363 and a registration clutch ON timer area 64, these areas being required when the RAM 36 serves as so-called software timers.

Outputs from a mode selector 44 the home switch 4, the timing switch 5, the paper feeding switches 24, 25, 26 and the registration switch 32 are adapted to be supplied to the CPU 34 through the I/O interface 37. A control signal supplied from the CPU 34 is adapted to be supplied, through the I/O interface 37, to an optical motor 38, paper feeding clutches 39, 40, 41, a loop clutch 42 and a registration clutch 43.

The optical motor 38 is disposed for moving the light source 3. The paper feeding clutches 39, 40, 41 respectively control the operation/stop mode of the set of the forward feeding roller 15, the paper feeding roller 18 and the retard roller 21, the set of the forward feeding roller 16, the paper feeding roller 19 and the retard roller 22, and the set of the forward feeding roller 17, the paper feeding roller 20 and the retard roller 23. The loop clutch 42 controls the operation/stop mode of the loop rollers 30. The registration clutch 43 controls the operation/stop mode of the registration rollers 31.

Figure 1:
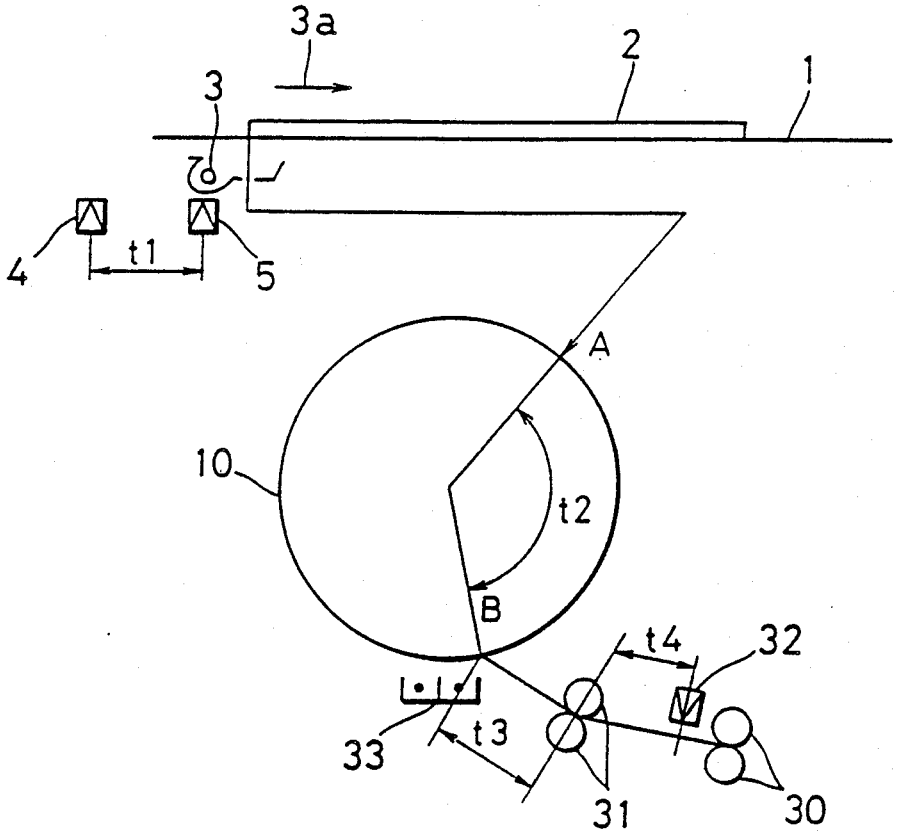
FIG. 1 is a view illustrating the relationship between a paper feeding operation and the operation of document scanning means of an image forming apparatus embodying the present invention.

FIG. 1 is a view illustrating the relationship between the paper feeding operation of the registration rollers 31 and the operation of the light source 3.

As shown in FIG. 1, when it is supposed that A represents the exposure position of the photoreceptor drum 10 and B represents the transfer position where paper comes in contact with the photoreceptor drum 10, t1, t2, t3 and t4 in FIG. 1 respectively represent the following:

t1: Period of time from the time at which the light source 3 has turned the home switch 4 OFF and started moving from the home position to the time at which the timing switch 5 is turned ON (i.e., the light source 3 reaches the scan starting position), when copying a document at magnification of 100%, i.e., equal magnification t2: Period of time during which the image formed at the exposure position A is moved to the transfer position B t3: Period of time from the time at which paper feed has been started by the registration rollers, 31 to the time at which the tip of the fed paper reaches the transfer position B t4: Period of time from the time at which the paper tip has been detected by the registration switch 32 to the time at which the paper tip reaches the registration rollers 31.

According to the apparatus of the present invention, the periods of time to be preset to carry out a good copying operation may be expressed, as follows, based on the time at which the registration switch 32 is turned ON.

(A) In the normal copying mode, without margin shifting or magnification (a) Operation time of the loop clutch 42 after the registration switch 32 has been turned ON;

$$(t4+\alpha)$$

where $\alpha$ is the time required for forming the "bending".

(b) Time by which the optical motor 38 is turned ON before the registration switch 32 is turned ON;

$$(t1+t2)-(t3+t4+\alpha)$$

(B) In a margin shift copying mode:

(a) Operation time of the loop clutch 42 after the registration switch 32 has been turned ON;

$$(t4+\alpha)$$

(b) Time by which the optical motor 38 is turned ON before the registration switch 32 is turned ON;

$$(t1+t2)-(t3+t4+\alpha+\beta)$$

where $\beta$ is a margin amount ($\beta$ is a negative value for the right margin, while $\beta$ is a positive value for the left margin).

(C) In a variable magnification copying mode:

(a) Operation time of the loop clutch 42 after the registration switch 32 has been turned ON;

$$(t4+\alpha)$$

(b) Time by which the optical motor 38 is turned ON before the registration switch 32 is turned ON;

$$\{(t1+\gamma)+t2\}-(t3+t4+\alpha)$$

where $\gamma$ is a variation in the time required for the light source 3 to reach the scan starting position from the home position, such time variation corresponding to the variation of magnification ($\gamma$ is a negative value for reduced magnification, while $\gamma$ is a is a positive value for enlarged magnification).

Thus, the times to be preset for copying operation depend on the copying mode applied.

In this embodiment, each of the set of the forward feeding roller 15, the paper feeding roller 18 and the retard roller 21, the set of the forward feeding roller 16, the paper feeding roller 19 and the retard roller 22, and the set of the forward feeding roller 17, the paper feeding roller 20 and the retard roller 23, takes out and feeds paper from each of the paper housing units 12, 13, 14 at predetermined time intervals determined according to the sizes of paper the housed in each of the paper housing units 12, 13, 14. Further, the timing at which paper is taken out in a series of copying operations, is maintained constant in any of the copying modes. To take out paper at predetermined time intervals, provision may be made, for example, such that each set of forward, feeding roller, paper feeding roller and retard roller is driven at predetermined time intervals, or such that, after a predetermined period of time has passed after the rear end of paper had been detected by each of the paper feeding switches 24, 25, 26, the next paper is taken out. The sizes of paper housed in each of the paper housing units 12, 13, 14 may be detected by the CPU 34 by detecting, for example, the type of each paper cassette (not shown). The CPU 34 is adapted to turn ON each of the paper feeding clutches 39, 40, 41 at predetermined time intervals according to the paper sizes thus detected.

In this embodiment, the time intervals at which paper is fed toward the photoreceptor drum 10 under control of the loop rollers 30, the registration rollers 31 and the like, are not changed but always remain constant for all copying modes, as will be discussed later. Such constant time intervals are equal to the constant time intervals above-mentioned at which paper is taken out. Further, the time at which paper is fed to the photoreceptor drum 10 in a series of copying operations is constant for all copying modes. As a result, the time at which paper is taken out from each of the paper housing units 12, 13, 14, and the time at which paper is fed to the photoreceptor drum 10 by the registration rollers 31 are constant regardless of the copying mode selected. On the other hand, the drive starting time of the light source 3 (the time at which the optical motor 38 is turned ON) varies with the copying mode selected. In this connection, the relationship between the time at which paper is fed to the photoreceptor drum 10 and the drive starting time of the light source 3, varies with the copying mode selected by selector 44. Accordingly, there may be produced copying results equivalent to those produced by the prior art in which the paper feed time varies with the copying mode selected by mode selector.

Figure 4:
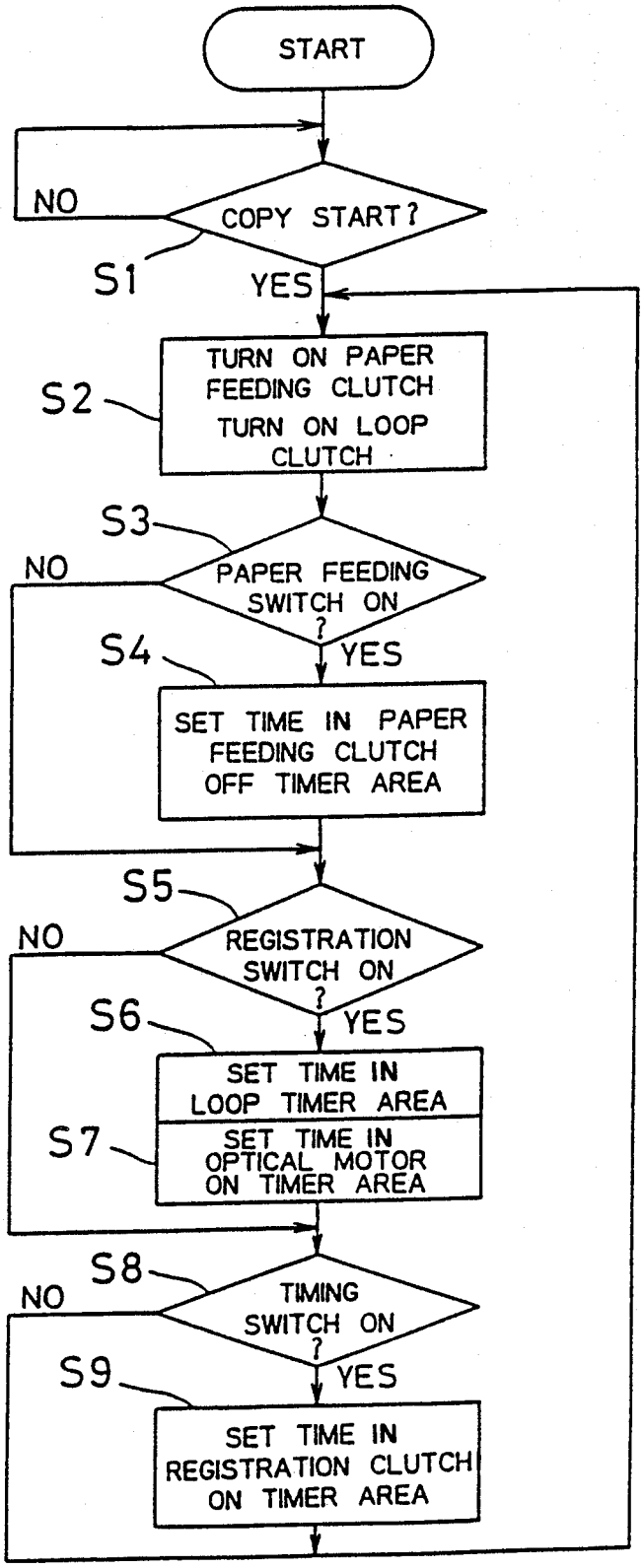
FIG. 4 is a main flow chart for the electric circuit 3.

FIG. 4 is a flow chart illustrating the control operation of the CPU 34. The following description will discuss the operation of the embodiment with reference to FIG. 4 and FIGS. 1 to 3.

When a copy start signal is given (step S1), the CPU 34 turns ON the paper feeding clutch 39, 40 or 41 corresponding to the paper housing unit selected from the three paper housing units 12, 13, 14 (step S2), thereby to start paper feeding.

Upon detection of an ON signal of the paper feeding switch 24, 25 or 26 (step S3), the CPU 34 sets the time to be preset in the paper feeding clutch OFF timer area 361 of the RAM 36 (step S4). Such time is equal to the sufficient and required period of time during which paper is delivered to the paper delivery passage 50 after having been taken out from the paper housing unit 12, 13 or 14 and detected by the paper feeding switch 24, 25 or 26.

When it is detected that the registration switch 32 is turned ON (step S5), the CPU 34 sets a predetermined time in the loop timer area 362 in the RAM 36 (step S6) and also sets another predetermined time in the optical motor ON timer area 363 (step S7).

Here, the term "predetermined time" refers to the time determined according to the copying mode described with reference to FIG. 1. A time of $(t4+\alpha)$ is set in the loop ,timer area 362 regardless of the copy mode selected. Set in the optical motor ON timer area 363 is the time of $(t1+t2)-(t3+t4+\alpha)$ for the normal copying mode, the time of $(t1+t2)-(t3+t4+\alpha+\beta)$ for the margin shift copying mode, or the time of $\{(t1+\gamma)+t2\}-(t3+t4+\alpha a)$ for the variable magnification copying mode. Thus, the time for which the loop clutch 42 remains turned ON is maintained constant, while the time at which the optical motor 38 is turned ON, varies with the copying mode applied.

When it is detected that the timing switch 5 is turned ON (step S8), the CPU 34 sets a predetermined time in the registration clutch ON timer area 364 (step S9).

Such set time is equal to the time $(t2-t3)$ for the normal copying mode, $\{t2-(t3+\beta)\}$ for the margin shift copying mode, or $(t2-t3)$ for the variable magnification copying mode. By setting such time to the registration clutch ON timer area 364, the time at which paper is fed in the transfer position B (See FIG. 1) may be fine-adjusted so that the timer image on the surface of the photoreceptor drum 10 is synchronized with paper according to the copying mode applied.

Based on the times respectively set in the optical motor ON timer area 363 and the registration clutch ON timer area 364, the period of time from the time at which the registration switch 32 has been turned ON, to the time at which the registration clutch 43 is turned ON, may be calculated as set forth below.

(A) In the normal copying mode:

$$-\{(t1+t2)-(t3+t4+\alpha)\}+t1+(t2-t3)=t4+\alpha$$

(B) In the margin shift copying mode:

$$-\{(t1+t2)-(t3+t4+\alpha+\beta)\}+t1+\{t2-(t3+\beta)\}=t4+\alpha$$

(C) In the variable magnification copying mode:

$$-[\{(t1+\gamma)+t2\}-(t3+t4+\alpha)]+(t1+\gamma)+(t2-t3)=t4+\alpha$$

Thus, the period of time from the time at which the registration switch 32 has been turned ON, to the time at which the registration clutch 43 is turned ON, is constant regardless of the copying mode selected. As mentioned earlier, paper is taken out from the paper housing unit 12, 13 or 14 at predetermined time intervals regardless of the copying mode selected. Accordingly, the time intervals at which the registration switch 32 is turned ON, are apparently equal to the predetermined time intervals above-mentioned. Accordingly, the time intervals at which the registration rollers 31 feed paper to the photoreceptor drum 10 are also equal to the predetermined time intervals above-mentioned. As a result, the time at which paper is taken out from the paper housing unit 12, 13 or 14, and the time at which the registration rollers 31 feed paper to the photoreceptor drum 10 are constant regardless of the copying mode applied. The paper stop period of time during which paper is being stopped by the registration rollers 31, is substantially equal to and constant. Alternatively, such control may be based on the time at which the registration clutch 43 is turned ON by the registration switch 32. However, to securely synchronize the toner image on the surface of the photoreceptor drum 10 with the paper, the control may be preferably carried out based on the time at which the timing switch 5 is turned ON, as done in the foregoing.

Synchronously with the control operation above-mentioned, the CPU 34 may carry out operations shown in FIGS. 5, 6, 7 and 8 when, for example, an interrupting operation or the like is required. The following description will discuss such operations.

Figure 5:
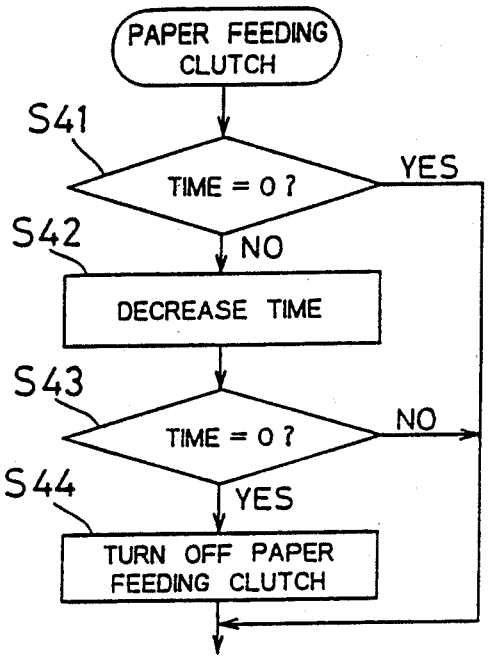
FIGS. 5, 6, 7 and 8 are flow charts illustrating detailed descriptions of electric circuit in FIG. 3.

FIG. 5 shows a control operation of the CPU 34 in connection with the paper feeding clutches 39, 40, 41.

When the time preset in the paper feeding clutch OFF timer area 361 is not equal to "0" (step S41), the CPU 34 decrements such time (step S42). When the remaining time is "0" (step S43), the CPU 34 turns OFF the paper feeding clutch 39, 40 or 41 which was turned ON at the step S2 (step S44).

Figure 6:
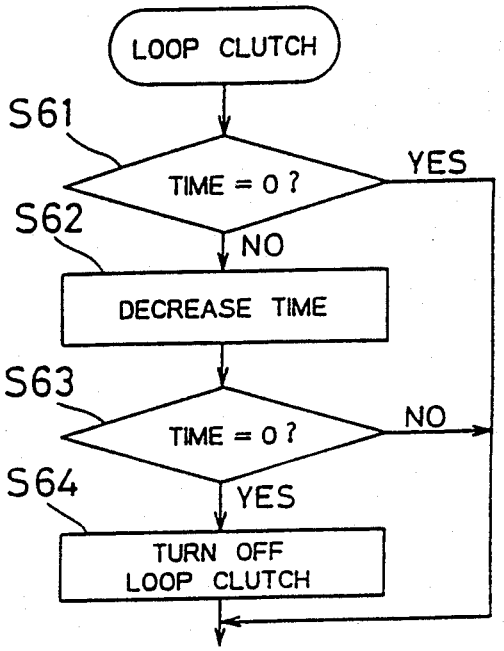

FIG. 6 shows a control operation of the CPU 34 in connection with the loop clutch 42.

When the time preset in the loop timer area 362 is not equal to "0" (step S61), the CPU 34 decrements such time (step S62). When the remaining time is "0" (step S63), the CPU 34 turns OFF the loop clutch 42 which was turned ON at the step S2 (step S64).

Figure 7:
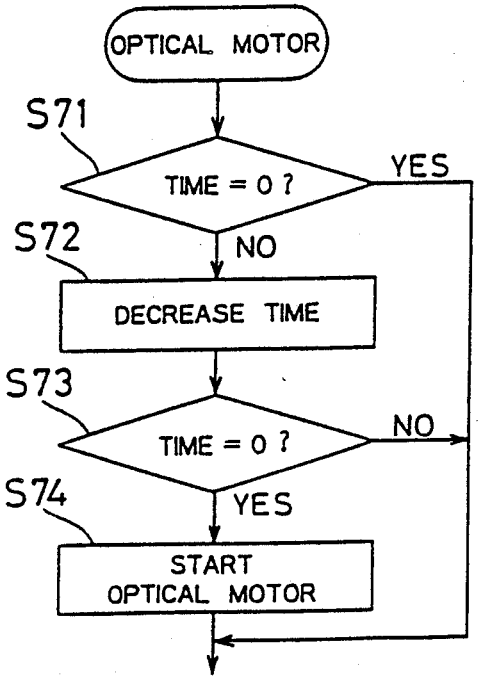

FIG. 7 shows a control operation of the CPU 34 in connection with the optical motor 38. When the time preset in the optical motor ON timer area 363 is not equal to "0" (step S71), the CPU 34 decrements such time (step S72). When the remaining time is "0" (step S73), the CPU 34 starts the optical motor 38 (step S74). Accordingly, the optical motor 38 is turned ON after the time stored in the optical motor ON timer area 363 has passed following turning ON of the registration switch 32.

Figure 8:
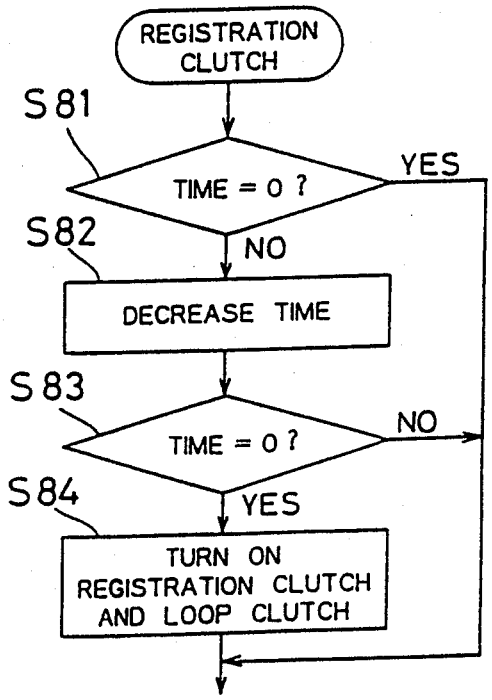

FIG. 8 shows a control operation of the CPU 34 in connection with the registration clutch 43. When the time preset is the registration clutch ON timer area 364 is not equal to "0" (step S81), the CPU 34 decrements such time (step S82). When the remaining time is "0" (step S83), the CPU 34 turns ON the registration clutch 43 and the loop clutch 42, thereby starting paper feed from the registration rollers 31 toward the photoreceptor drum 10 (step S84). This adjusts, in a fine manner, the timing at which paper is fed from the registration rollers 31 to the transfer position B.

In the control operations of the CPU 34 shown in FIGS. 5 to 8, constant times are respectively set in the paper feeding clutch OFF timer area 361 and the loop timer area 362 regardless of the copying mode applied. When the copying mode is changed, it is necessary to change the relationship between the drive starting time of the light source 3 and the paper feed time. Such a change is made by setting different times in the optical motor ON timer area 363 in different copying modes, respectively.

As a result, both the time at which paper is taken out from the paper housing unit 12, 13 or 14, and the time at which the registration rollers 31 feed paper to the photoreceptor drum 10 are constant regardless of the copying mode selected Further, the period of time during which paper is being stopped by the registration rollers 31 as above-mentioned, is substantially constant regardless of the copying mode applied. Accordingly, even though the copying mode is changed with paper being present in the paper delivery passage 50, there is no likelihood of paper collision and paper jam therein. This assures a smooth change in copying mode.

It is understood that the present invention is not limited to the embodiment above-mentioned. In this embodiment, the times to be respectively set in the loop timer area 362, the optical motor ON timer area 363 and the registration clutch ON timer area 364 are set based on the time at which the registration switch 32 is turned ON. Alternatively, such times may be set based on the time at which the paper feeding switch 24, 25 or 26 is turned ON. Further, in the embodiment above-mentioned, the light source 3 is adapted to scan the document 2. Alternatively, a photo sensor-array can be used for scanning the document and reading the image thereof. A variety of other modifications may be made without departing from the scope of the present invention.

What I claim is:

1. An image forming apparatus for forming an image of a document, the image being formed in one of a plurality of image forming modes including a normal image forming mode in which the image is a substantially exact reproduction of the document, said apparatus comprising:

document scanning means responsive to a start signal for scanning a document;

image forming means for forming an image of the scanned document;

paper feeding means for successively feeding sheets of paper from a paper supply at predetermined time intervals;

means defining a paper delivery passage having a first end adjacent said paper feeding means and a second end adjacent said image forming means, for delivering sheets of paper from said paper feeding means to said image forming means;

registration means in said paper delivery passage for stopping the delivery of the sheets of paper therethrough for a predetermined time;

mode selecting means permitting selecting of one of the plurality of image forming modes;

detecting means for detecting a sheet of paper within said paper delivery passage prior to such sheet of paper passing said registration means;

control means responsive to the selected image forming mode and to detection of a sheet of paper by said detecting means for applying a start signal to said document scanning means at a time following said detection which time is determined in accordance with the selected image forming mode, so that the mode selected by said mode selecting means may be changed while said image forming apparatus is operating, even though one or more sheets of paper are in said paper delivery passage, without collision of sheets of paper within said paper delivery passage; and image transfer means for transferring an image from said image forming means onto a sheet of paper, delivered thereto from said paper delivery passage, and delivery of the sheet of paper therefrom.

2. An image forming apparatus according to claim 1, wherein said apparatus is an electrophotographic copying apparatus, said document scanning means includes a light source for illuminating the document, and said image forming means includes a photoreceptor adapted to be exposed to light reflected from the document to form an electrostatic latent image on the surface of said image forming means.

3. An image forming apparatus according to claim 2, wherein:

said mode selecting means is capable of selecting a margin shift image forming mode in which the image is transferred to the sheet of paper with a margin along one side of the sheet of paper that is shifted from the margin of the document, a variable magnification image forming mode in which the image formed in said image forming means and transferred to the sheet of paper is enlarged or reduced with respect to the document, and a normal image forming mode in which the margin of the transferred image corresponds to the margin of the document and the size of the transferred image corresponds with the size of the document.

4. An image forming apparatus according to claim 1, wherein:

said registration means comprises a pair of registration rollers disposed in the vicinity of said image forming means and a pair of loop rollers disposed upstream of said registration rollers in said paper delivery passage, said registration rollers being adapted to feed the sheet of paper to said image forming means after said loop rollers have caused the tip of said sheet of paper to come into contact with said registration roller and have caused the sheet of paper to be bent.

5. An image forming apparatus according to claim 1, wherein:

said paper feeding means includes a forward feeding roller to taking out sheets of paper from the paper supply, a paper feeding roller for feeding the sheets of paper thus taken out to said paper delivery passage, and a retard roller disposed adjacent the paper feeding roller to prevent a plurality of paper sheets from being simultaneously fed to said paper delivery passage.

6. An image forming apparatus according to claim 1, wherein:

said paper delivery passage has a length more than twice the length of the sheets of paper, permitting a plurality of the sheets of paper to be therein for delivery simultaneously.

7. An image forming apparatus according to claim 1, wherein:

said detecting means comprises a registration switch for detecting the tip of the sheet of paper in the paper delivery passage between the loop rollers and the registration rollers.

8. An image forming apparatus according to claim 1 wherein:

said detecting means comprises a paper feeding switch for detecting the tip of a sheet of paper immediately after feeding thereof from the paper supply.

* * * * *